US010563845B2

(12) United States Patent
Hadjian et al.

(10) Patent No.: US 10,563,845 B2
(45) Date of Patent: Feb. 18, 2020

(54) LUMINAIRE

(71) Applicant: WESTGATE MFG, INC., Vernon, CA (US)

(72) Inventors: Ebrahim (Avi) Hadjian, Los Angeles, CA (US); Eshagh Hadjian, Los Angeles, CA (US)

(73) Assignee: Westgate MFG, Inc., Vernon, CA (US)

( * ) Notice: Subject to any disclaimer, the term of this patent is extended or adjusted under 35 U.S.C. 154(b) by 0 days.

(21) Appl. No.: 15/950,108

(22) Filed: Apr. 10, 2018

(65) Prior Publication Data

US 2019/0309929 A1 Oct. 10, 2019

(51) Int. Cl.

| | |
|---|---|
| ***F21V 17/00*** | (2006.01) |
| ***F21V 15/01*** | (2006.01) |
| *F21V 23/00* | (2015.01) |
| *F21Y 115/10* | (2016.01) |

(52) U.S. Cl.

CPC ..... *F21V 17/002* (2013.01); *F21V 15/01* (2013.01); *F21V 23/001* (2013.01); *F21Y 2115/10* (2016.08)

(58) Field of Classification Search

CPC ..... F21V 17/002; F21V 17/06; F21V 21/02; F21V 21/025; F21S 8/03; F21S 8/0333

USPC ..... 362/249, 0.1–0.3, 0.6

See application file for complete search history.

(56) References Cited

U.S. PATENT DOCUMENTS

2013/0329424 A1* 12/2013 Clark ..... F21S 2/005 362/235

2014/0268775 A1* 9/2014 Kennemer ..... F21L 14/00 362/249.03

OTHER PUBLICATIONS

Alrisha LED Wall Sconce, Before Apr. 10, 2018.

* cited by examiner

*Primary Examiner* — Sean P Gramling
*Assistant Examiner* — Keith G. Delahoussaye
(74) *Attorney, Agent, or Firm* — Payam Moradian

(57) ABSTRACT

Provided is a light fixture comprising: a) a base; b) two housings for housing at least one light source each, the light source housing placed on the base, each housing configured for removable attachment to an accessory; c) an accessory for removably attaching to the housing; wherein the fixture is configured to be used with interchangeable accessories. Provided is light fixture comprising: a) a rectangular base; b) two housings for housing at least one light source each, the light source housings placed on the base; c) four LED boards as the light source, wherein each of the housings have two LED boards, all of the four LED boards placed in parallel configuration; each housing having an LED board facing a first end and a second end of the rectangular base in a parallel configuration to the end of the rectangular base, each of the housings configured for removable attachment of an accessory; and d) an accessory for removably attaching to the two housings.

6 Claims, 15 Drawing Sheets

LUMINAIRE

BACKGROUND SECTION OF THE INVENTION

There are many types of luminaires (light fixtures) for a consumer to choose in the market place. A problem with luminaires is that after a while they become stale to the user's eyes. There is a need in the art for a luminaires that a consumer can customize and change from one look to another.

SUMMARY SECTION OF THE INVENTION

Provided is a light fixture comprising: a) a base; b) two housings for housing at least one light source each, the light source housings placed on the base; c) an accessory for removably attaching to the housing; wherein the fixture is configured to be used with interchangeable accessories. The accessory can be a single piece and connects to both the housings. The housing can comprise a recess for receiving the accessory. The housings can comprise one or more slots for receiving the accessory. Two slots can exist in a U configuration. The slots can be located on top, the top being opposite side of which the base is located, for attachment to the accessory. The light fixture further comprises fastener openings for attachment of the accessory on sides of the housing facing length of the base. The light sources can be LED boards positioned in parallel configuration. The housings can be cuboid. The base can be rectangular. Each of the housings can have a first and second opening in opposite directions for placement of parallel LED boards as the light source, wherein the two housings are placed in such configuration that all LED boards from all the housings are in parallel configuration.

Provided is a light fixture comprising: a) a rectangular base; b) two housings for housing at least one light source each, the light source housings placed on the base; c) four LED boards as the light source, wherein each of the housings have two LED boards, all of the four LED boards placed in parallel configuration; each housing having an LED board facing a first end and a second end of the rectangular base in a parallel configuration to the width of the rectangular base, each of the housings configured for removable attachment of an accessory; and d) one accessory for removably attaching to the two housings; wherein the fixture is configured to be used with interchangeable accessories. The accessory can comprise a U-shaped extension, and wherein the housing comprises two slots for accepting the U-shaped accessory. The housing can be cuboid. The cuboid can be attached to the rectangular base on one side of the cuboid, and the slot is present on a surface of the cuboid on opposite side of the attachment.

DETAILED DESCRIPTION OF THE INVENTION

Figure 1:
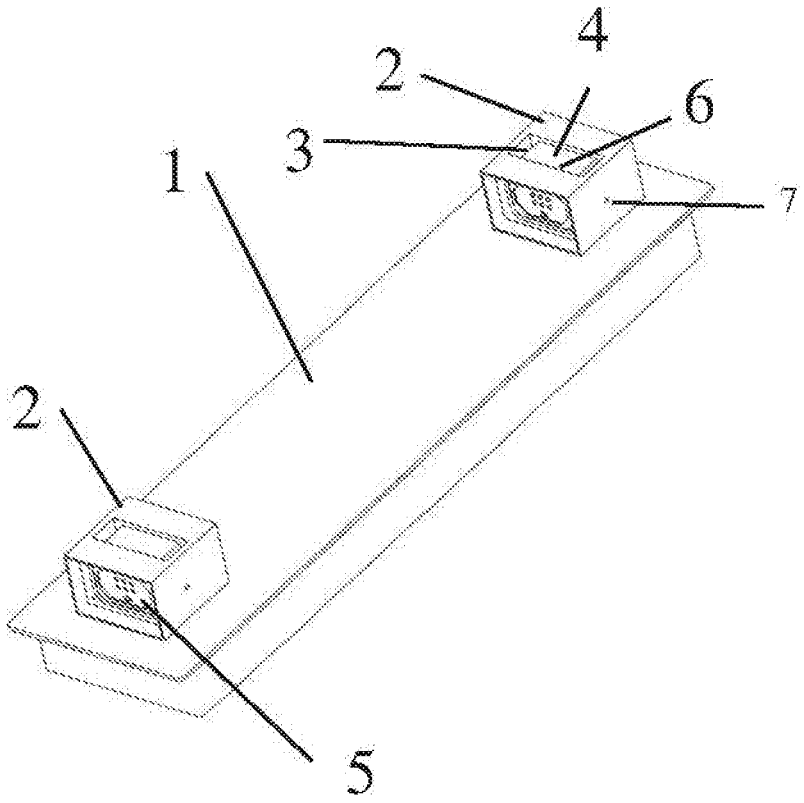
FIG. 1 illustrates a perspective view of the light fixture.

FIG. 1 illustrates a perspective view of the light fixture. In the light fixture, one or more LED (Light Emitting Diode) housings 2 are attached to base 1. Base 1 can have a flat rectangular surface for attaching LED housing 2. Each LED housing 2 can have one or more LED boards 5 with a plurality of individual LED units. The LED boards 5 can be parallel to the width of the rectangular base 1.

As illustrated in FIG. 1, the housing 2 is attached to base 1 at its bottom. The two sides of housing 2 have a fastener opening for attaching an accessory 23. The front and back of LED housing 2 have openings for placement of LED boards 5. The LED Board 5 can emit light from front and back of housing 2. On top of housing 2 there can be a recess 6, with an inverted U-shaped receiver with one or more slots 3 for receiving an accessory 23. The accessory 23 can be placed in recess 6, secured with slots 3, and removably attached to housing 2 through fastener openings 7.

In the configuration illustrated in FIG. 1, two housings are placed on base 1, which the inner LED boards 5 of each housing 2 running parallel to each other and facing each other. Each housing 2 has an LED board 5 in the front and an LED board 5 on the back. If base 1 is oriented vertically, light from LED boards, would emanate upward and downward from each housing 2.

Figure 2:
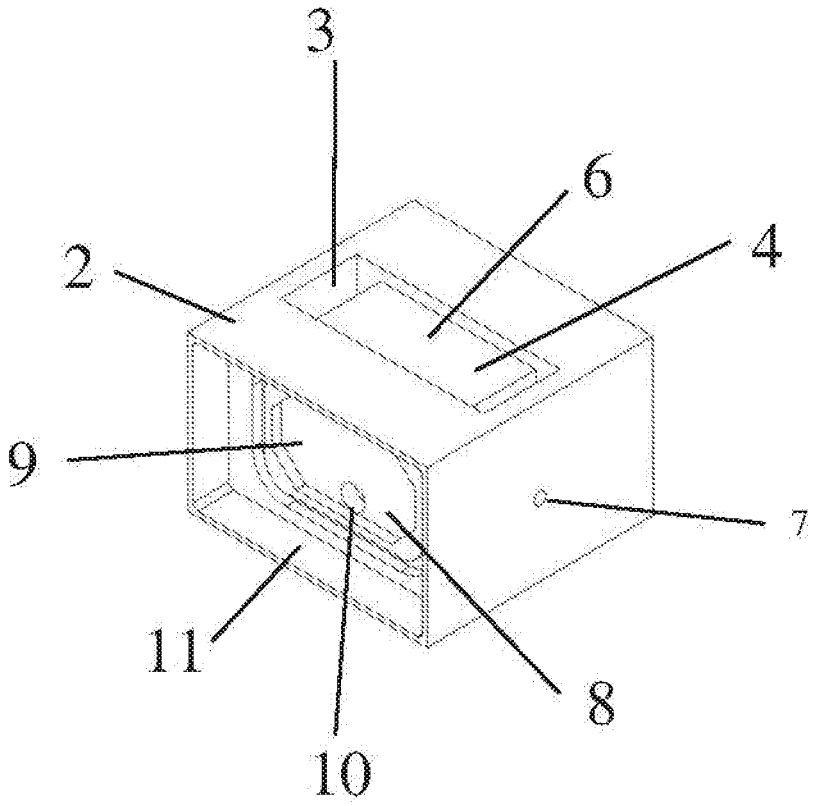
FIG. 2 illustrates a perspective view of the LED housing.

FIG. 2 illustrates a perspective view of housing 2. On top of housing 2, recess 6 is visible, with a receiver 4 and two slots 3 on each side of receiver 4. Fastener opening 7 on the side is also visible in this view.

FIG. 2 also illustrates the front or back end of housing 2 where an LED board 5 is placed. Housing 2 can have a flange portion 11 around and in front of where LED board 5 is placed. In the back of opening 8, an LED slot 9 is present where LED board 5 is placed. A wire opening 10 can allow for wire to travel from inside of housing 2 to LED board 5 placed in front of slot 9.

Figure 3:
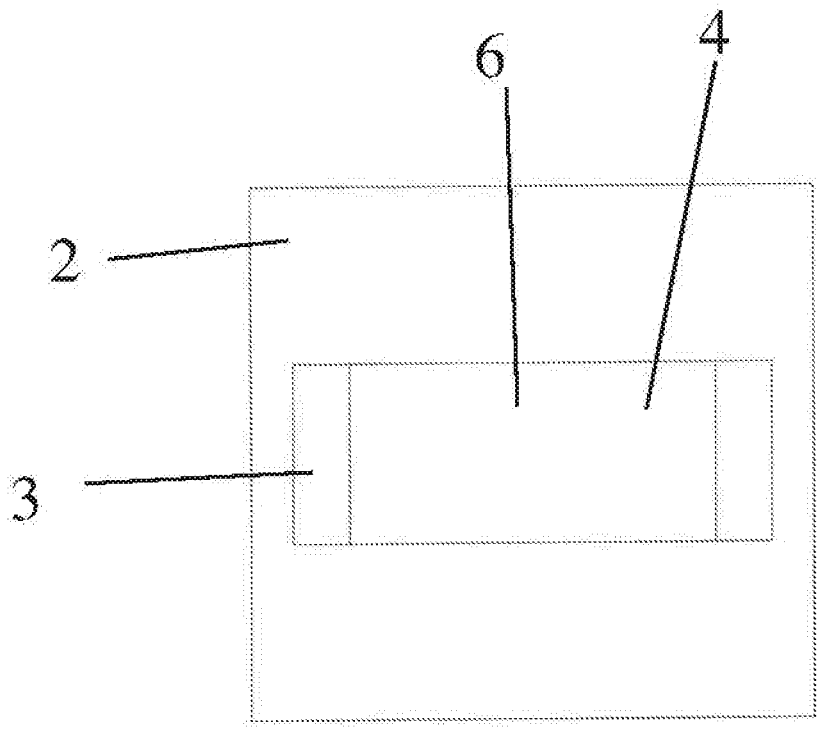
FIG. 3 illustrates top view of the LED housing (top in relation to the base).
Figure 4:
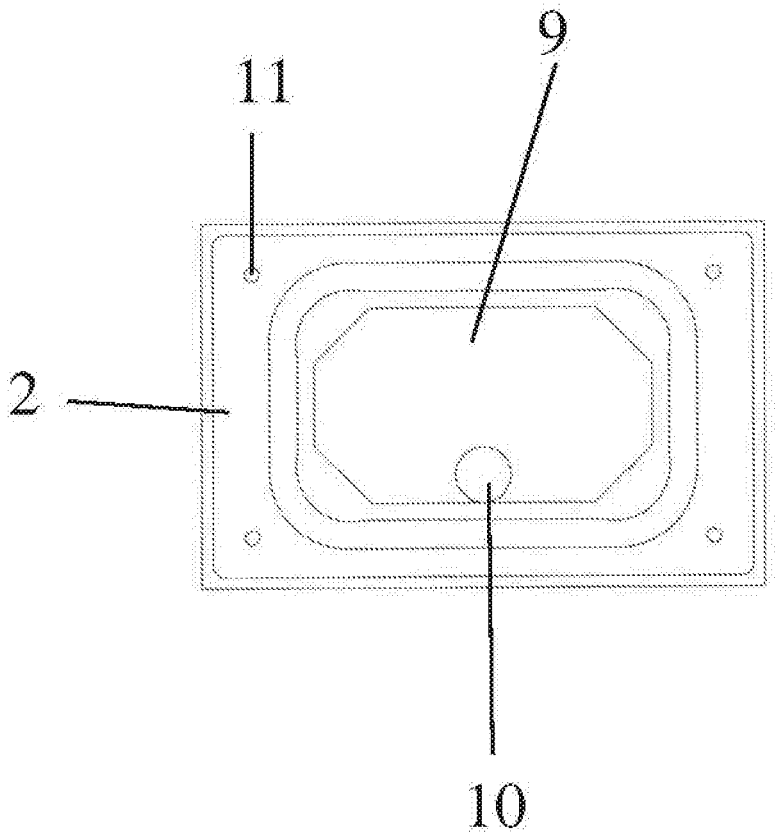
FIG. 4 illustrates front or back of the LED housing.

FIG. 3 illustrates top of housing 2. Visible in this view are slot 3 and receiver 4, FIG. 4 illustrates a front or back view of housing 2. Illustrated in this view are fastener openings 11. The LED board 5 is placed in LED slot 9. A transparent cover (not illustrated) is placed in front of slot 9 and is fastened to fastener openings 11.

Figure 5:
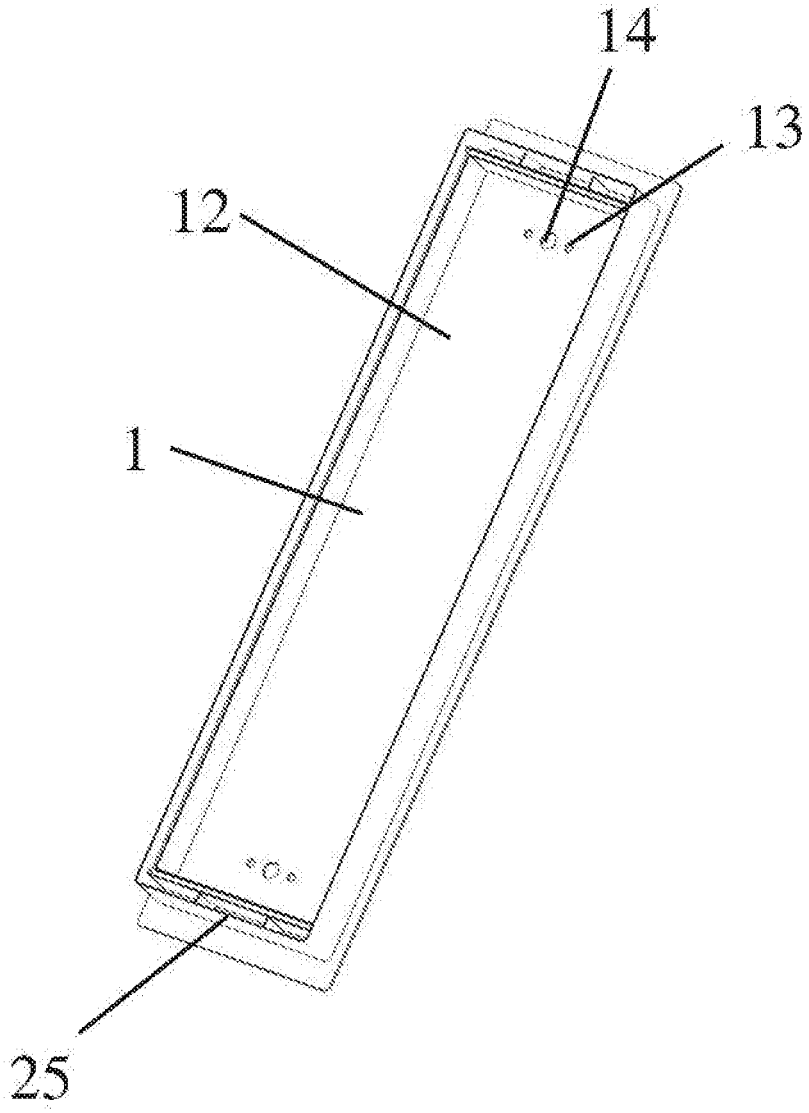
FIG. 5 illustrates bottom of the base where the electronic components are placed.
Figure 6:
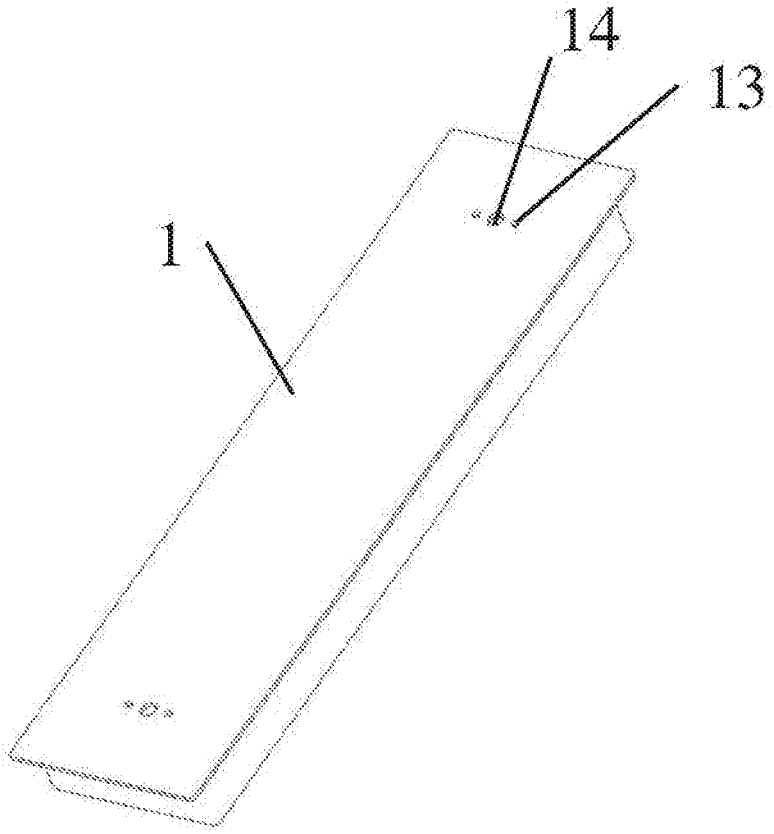
FIG. 6 illustrates top of the base to which the LED housings are attached.

FIG. 5 illustrates inside of base 1. Inside of base 1 there is a cavity 12 for placement of a ballast 28 and other electronic components such as wires. Top of base 1 has wire opening 14 for passage of wires to housing 2 and fastener openings 13 for attachment to housing 2. FIG. 6 illustrates the top of base 1 with fastener openings 13 and wire openings 14. The top of base 1 can be rectangular, and the walls of cavity 12 can be recessed in relation to top of base 1.

Figure 7:
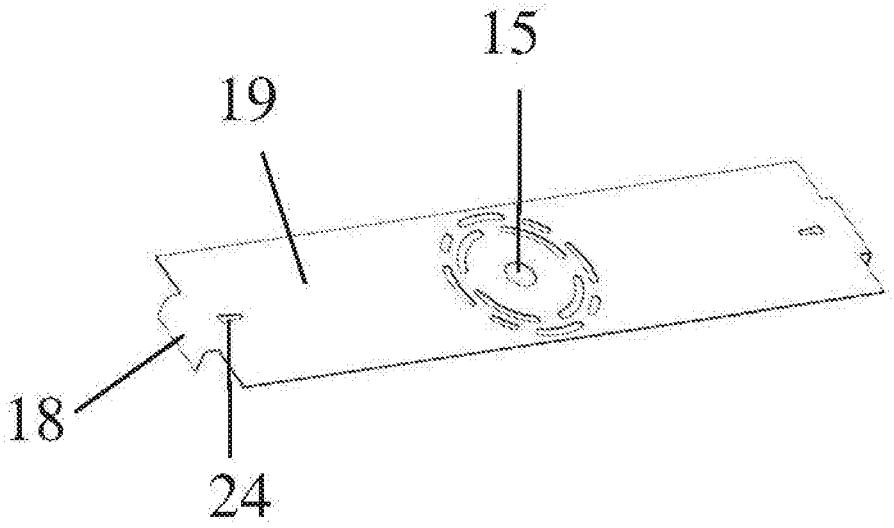
FIG. 7 illustrates a cover to be put at the open end of the base.

FIG. 7 illustrates cover 19 of base 1. The cover 19 can have wire opening 15, additional openings 24 for attachment to a support such as a wall, and extensions 18 for attaching to slot 3 of base 1.

Figure 8:
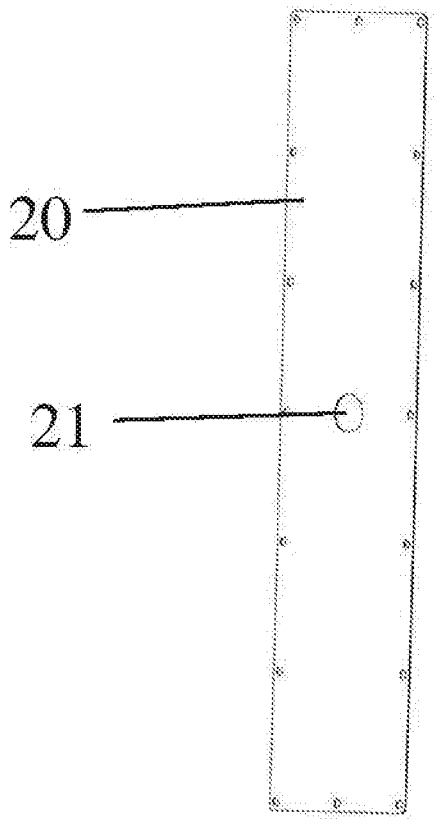
FIG. 8 illustrates a plate for putting in between the base and the cover.

FIG. 8 illustrates plate 20 with wire opening 21. Plate 20 can be placed in between base 1 and cover 19.

Figure 9:
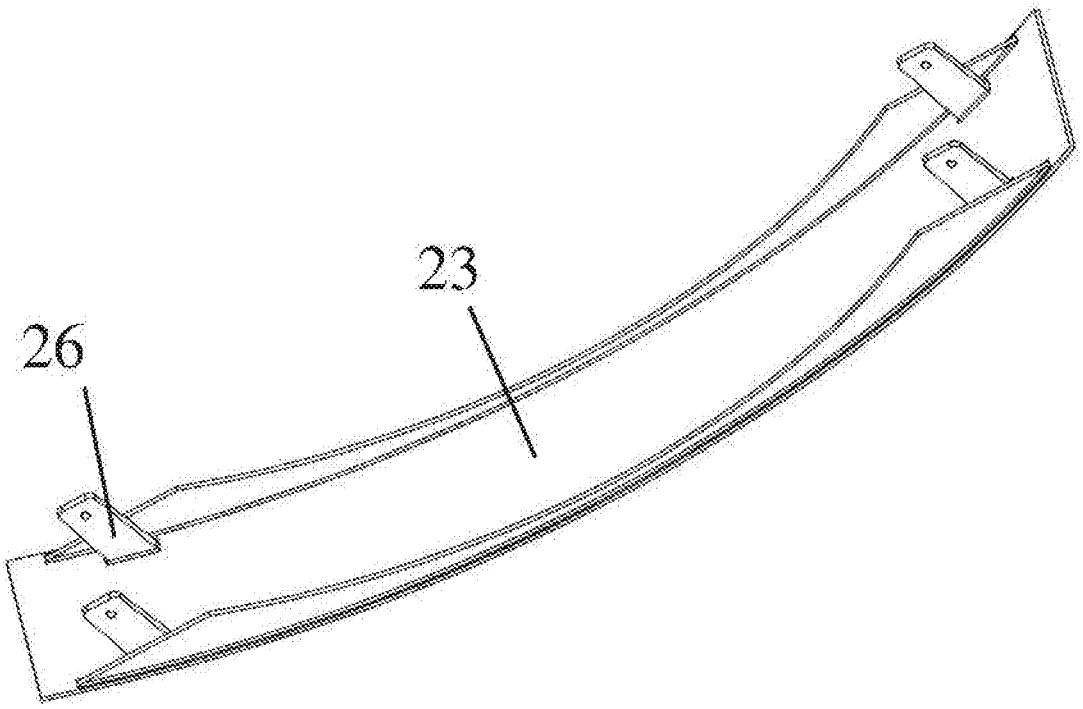
FIG. 9 illustrates an accessory.
Figure 10:
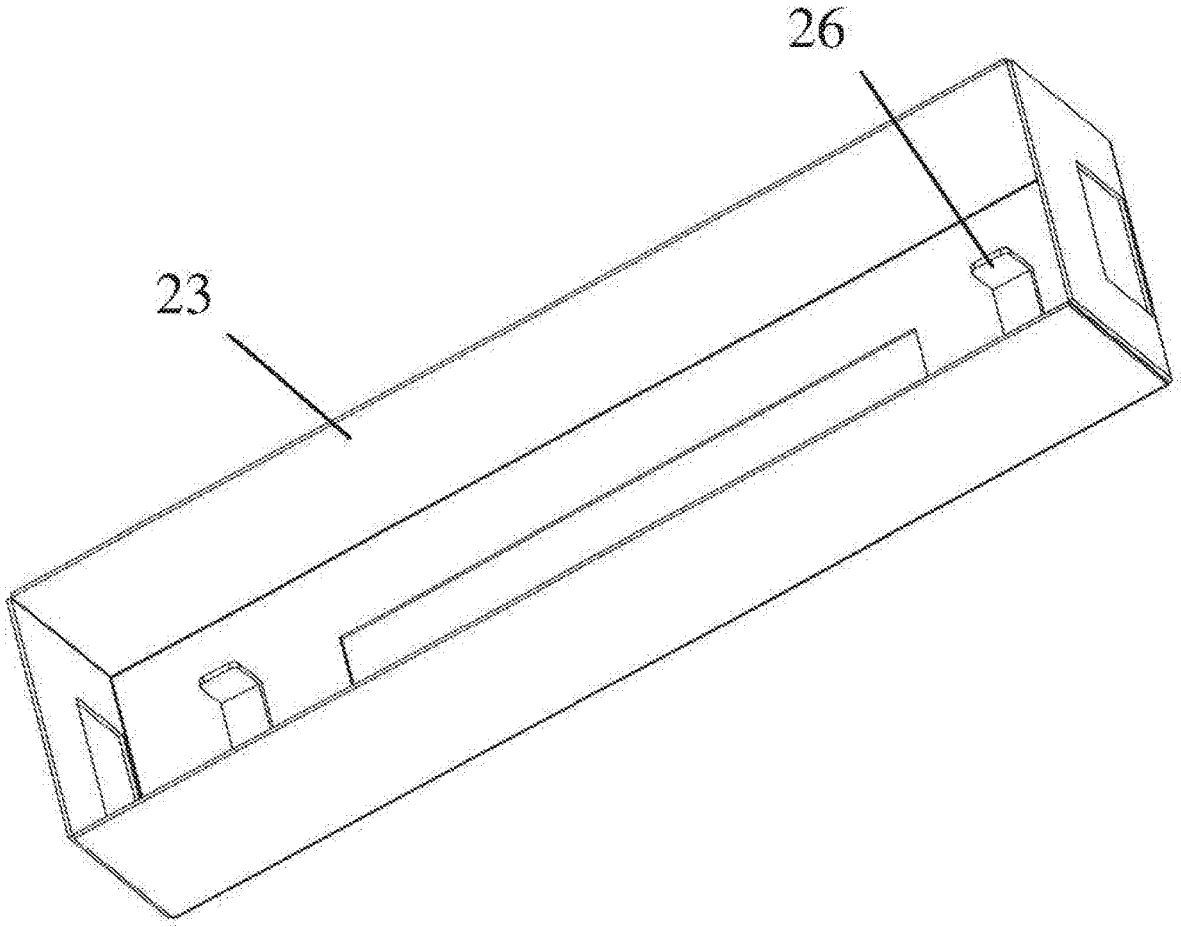
FIG. 10 illustrates an accessory.
Figure 11:
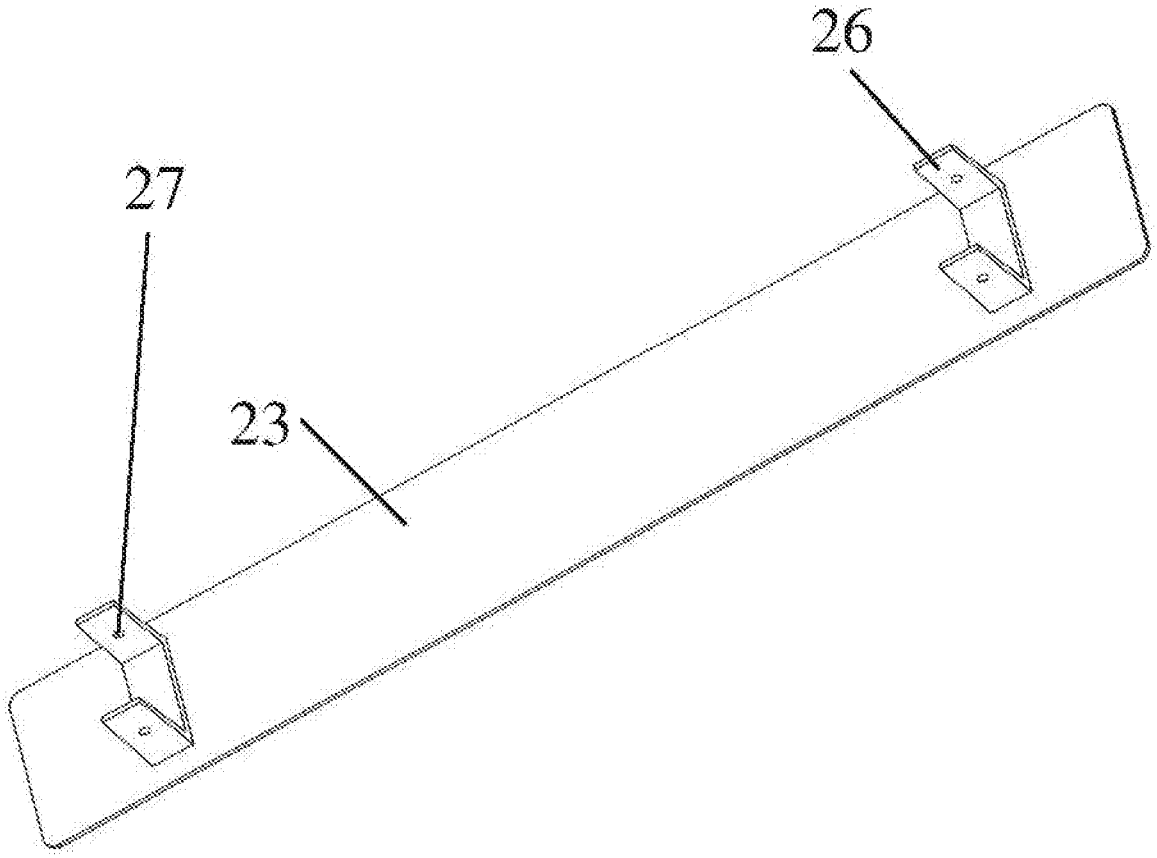
FIG. 11 illustrates an accessory.
Figure 12:
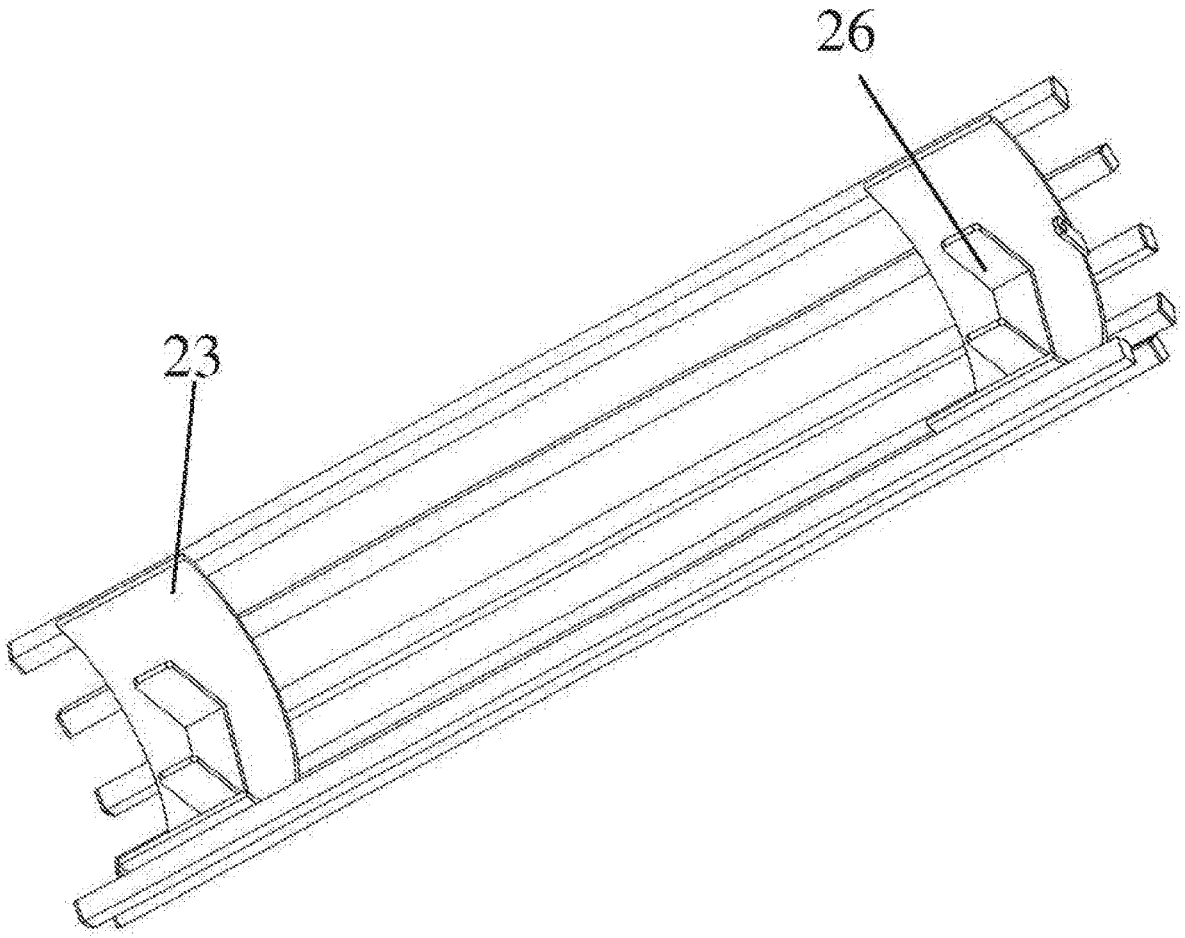
FIG. 12 illustrates an accessory.
Figure 13:
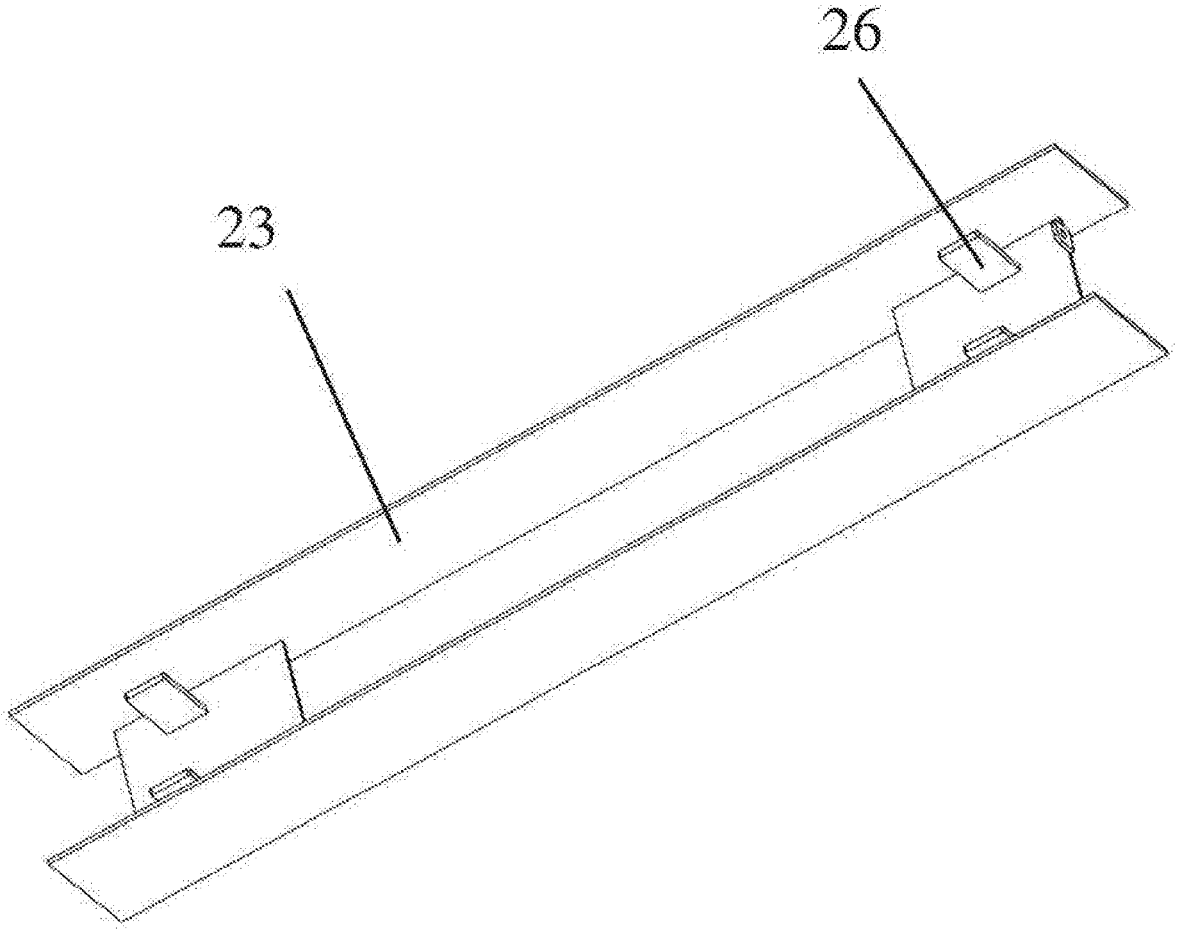
FIG. 13 illustrates an accessory.
Figure 14:
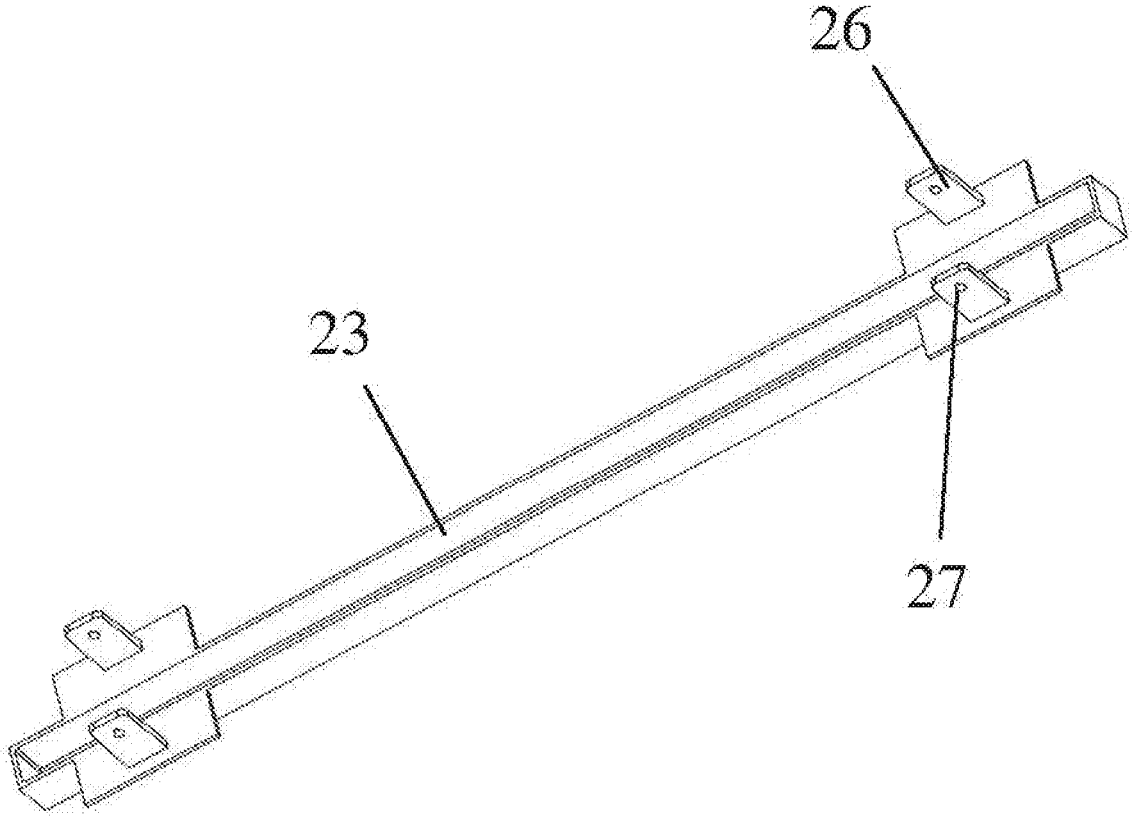
FIG. 14 illustrates an accessory.
Figure 15:
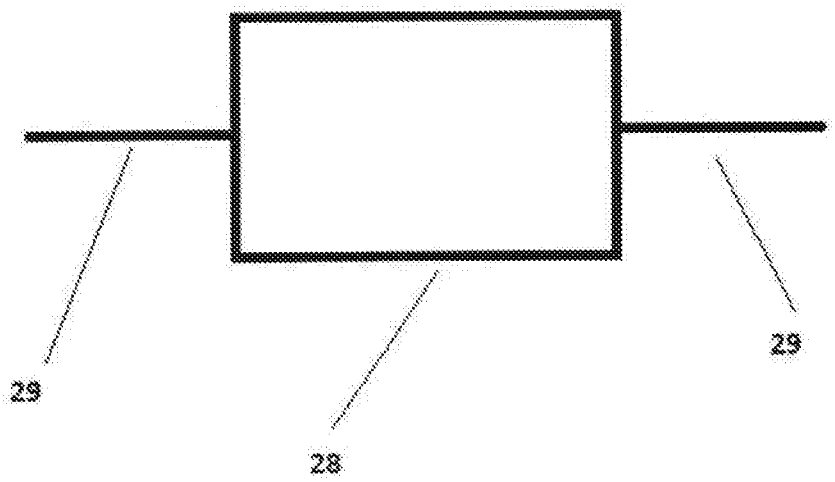
FIG. 15 illustrates a ballast with a wire coming in (usually from a power source such an outlet) and a wire going out (usually to the light source (LED)).

FIGS. 9-14 illustrate accessories 23 with various designs. The accessories have tabs 26, which are configured to be placed in slot 3 of LED housing 2. There can be two pairs of tabs 26. Each tab 26 can have a fastener opening 27 that complements the fattener opening 7 on LED housing 2. FIG. 9 illustrates a convex shaped accessory. FIG. 10 illustrates a box-shaped accessory with a window. FIG. 11 illustrates a flat rectangular shaped accessory. FIG. 12 illustrates an accessory with a plurality of parallel bars. FIG. 13 illustrates an accessory with two perpendicularly placed rectangles, creating a window in between. FIG. 14 illustrates an accessory in the shape of a bar.

To prepare the light fixture, ballasts 28 and wiring is placed inside cavity 12 of base 1. Plate 20 and cover 19 are placed at the end of base 1. The LED housing 2 is attached to the top of base 1, such as in the configuration of two LED housings 2 with each housing having two LED boards 5 in parallel configuration, and oriented downward/upward (relative to vertical installation). The light fixture is attached to the wall or other support through opening 16. Wires (such as wire 29 from the ballast) are let out of the wire openings, and connected to a power source (typically an AC outlet) to power LED board 6. An accessory 23 can be attached to the housing 2 at any time. The accessory 23 can have one or more extensions 26 for removably fitting in the slots on top of housing 2. Openings 26 on tabs 23 can be fastened to the sides of the housing 2.

REFERENCES

1. Base
2. Housing
3. Slot
4. Receiver
5. LED Board
6. Recess
7. Fastener opening (for attaching accessory)
8. Opening (For LED Board)
9. LED slot
10. Wire opening (For wire to LED Board)
11. Flange
12. Cavity
13. Fastener Opening
14. Wire Opening (Plate)
15. Wire Opening (Cover)
16. Opening on cover
18. Extension of cover
19. Cover (for base)
20. Plate
21 Opening (wire opening on plate)
22. LED cover
23. Accessory
24. Opening on plate (for attaching to support)
25. Slots on base
26. Tabs
27. Opening on tabs
28. Ballast
29. Wire

What is claimed is:

1. A light fixture comprising:

a) a rectangular base;

b) two light source housings for housing at least one light source each, the light source housings placed on a front side of the base;

c) each of the at least one light sources comprising two LED boards, wherein each of the two light source housings have two LED boards contained therein, and all of the four LED boards placed in parallel configuration; each housing having an LED board facing a first end and a second end of the rectangular base in a parallel configuration to each other and perpendicular to the rectangular base for lighting downward and upward in opposite directions relative to the base having a vertical orientation, each of the housings having a recess configured for removable attachment of an interchangeable accessory; and d) one single piece accessory for removably attaching to the recess of the two housings, the accessory positioned in front of the two housings to create a space in between the accessory and the rectangular base;

wherein two of the LEDs boards are directed inside of the space and two of the LED boards are directed outside of the space.

2. The light fixture of claim 1, wherein the single piece accessory comprises a U-shaped extension, and wherein each housing of the light sources comprises two slots for accepting the U-shaped extension of the single piece accessory.

3. The light fixture of claim 2, wherein each housing is a cuboid.

4. The light fixture of claim 3, wherein the cuboid is attached to the rectangular base on one side of the cuboid, and the two slots are configured on a surface of the cuboid on an opposite of the attachment to the rectangular base.

5. A light fixture comprising:

a rectangular base;

b) two light source housings for housing at least one light source each, the light source housings placed on a front side of the base;

c) each of the at least one light sources comprising two LED boards, wherein each of the two light source housings have two LED boards contained therein, and all of the four LED boards placed in parallel configuration; each housing having an LED board facing a first end and a second end of the rectangular base in a parallel configuration-to each other and perpendicular to the length of the rectangular base for lighting downward and upward in opposite directions, each of the housings having a recess configured for removable attachment of an interchangeable accessory; and d) one single piece accessory for removably attaching to the recess of the two housings, the accessory positioned in front of the two housings to create a space in between the accessory and the rectangular base;

wherein two of the LEDs boards are directed inside of the space and two of the LED boards are directed outside of the space.

6. A light fixture comprising:

a) a rectangular base;

b) two light source housings for housing at least one light source each, the light source housings placed on the base;

c) each of the at least one light sources comprising two LED boards, wherein each of the two light source housings have two LED boards contained therein, and all of the four LED boards placed in parallel orientation, each of the housings configured for removable attachment of an interchangeable accessory; and d) one single piece accessory for removably attaching to the two housings, the accessory positioned in front of the two housings to create a space in between the accessory and the rectangular base;

wherein two of the LEDs boards are directed inside of the space and two of the LED boards are directed outside of the space.

* * * * *